US011414875B2

(12) United States Patent
Bordin

(10) Patent No.: US 11,414,875 B2
(45) Date of Patent: Aug. 16, 2022

(54) BASEBOARD

(71) Applicant: PROGRESS PROFILES SPA, Asolo (IT)

(72) Inventor: Dennis Bordin, Asolo (IT)

(73) Assignee: PROGRESS PROFILES SPA, Asolo (IT)

( * ) Notice: Subject to any disclaimer, the term of this patent is extended or adjusted under 35 U.S.C. 154(b) by 0 days.

(21) Appl. No.: 17/106,994

(22) Filed: Nov. 30, 2020

(65) Prior Publication Data

US 2021/0180336 A1 Jun. 17, 2021

(30) Foreign Application Priority Data

Dec. 11, 2019 (IT) ..... 102019000023565

(51) Int. Cl.
*E04F 19/04* (2006.01)

(52) U.S. Cl.
CPC ..... *E04F 19/0468* (2013.01); *E04F 19/0477* (2013.01); *E04F 2019/0422* (2013.01)

(58) Field of Classification Search
CPC ... E04F 19/04; E04F 19/0468; E04F 19/0477; E04F 2019/0422
See application file for complete search history.

(56) References Cited

U.S. PATENT DOCUMENTS 1,488,090 A * 3/1924 Buhr ..... E04F 19/04 52/288.1
3,408,250 A * 10/1968 Finefrock ..... E04F 19/04 428/121
3,739,423 A * 6/1973 Denton ..... B44C 7/022 16/16
4,198,455 A * 4/1980 Spiro ..... B32B 21/08 428/126
4,661,391 A * 4/1987 Schroder ..... B29C 44/146 428/159
5,743,064 A * 4/1998 Bennett ..... B29C 66/4722 256/59

(Continued)

FOREIGN PATENT DOCUMENTS

AU 2009202220 A1 12/2009
BE 1020251 A5 7/2013

(Continued)

OTHER PUBLICATIONS

EP Extended Search Report dated May 11, 2021 re: Application No. 20211614.1, pp. 1-8, citing: AU 2009 202 220 A1, DE 20 2011 110712 U1, JP 2004 211469 A, GB 2 516 063 A, wO 01/50062 A1 and GB 2 124 267 A.

*Primary Examiner* — James M Ference
(74) *Attorney, Agent, or Firm* — Cantor Colburn LLP

(57) ABSTRACT

A baseboard having a profiled element with a substantially longitudinal extension.

The baseboard further includes one or more facilitated breakage regions which define respective detachable portions which are configured to be detached from the profiled element. The facilitated breakage regions are mutually parallel and extend over the entire longitudinal extension of the profiled element. The facilitated breakage regions are equidistant and may have non-through longitudinal incisions defined on a face of the profiled element, configured to remain in view.

6 Claims, 2 Drawing Sheets

(56) References Cited

U.S. PATENT DOCUMENTS 6,122,872 A * 9/2000 Sauter ..... H02G 3/0425 52/287.1
6,802,161 B1 * 10/2004 Robinson ..... A47K 3/008 52/287.1
6,918,977 B1 * 7/2005 Maurer ..... E04F 19/0436 156/249
7,574,836 B2 * 8/2009 Wesolowska ..... E04F 19/04 439/216
8,375,663 B2 * 2/2013 Johnston ..... E04B 2/7422 52/287.1
9,115,532 B1 * 8/2015 Sherman ..... E06B 9/24
2003/0140583 A1 * 7/2003 Sauter ..... E04F 19/0468 52/287.1
2004/0040235 A1 * 3/2004 Kurtz ..... H02G 3/0425 52/288.1
2005/0055936 A1 * 3/2005 Murphy, Jr. ..... B29C 66/1162 52/506.01
2005/0249923 A1 * 11/2005 Reichwein ..... E04F 19/04 428/195.1
2006/0260262 A1 * 11/2006 Richardson ..... E04F 19/049 52/716.1
2007/0006545 A1 * 1/2007 Johnston ..... E04F 19/026 52/745.09
2007/0175139 A1 * 8/2007 Nicolson ..... B28B 7/348 52/309.17
2008/0236072 A1 * 10/2008 Johnston ..... H02G 3/0425 52/290
2008/0263979 A1 * 10/2008 Richardson ..... E04F 19/049 52/287.1
2010/0281798 A1 * 11/2010 Sondermann ..... E04F 19/0481 52/288.1
2011/0108318 A1 * 5/2011 Pawlak ..... E04F 19/0463 174/504
2011/0131919 A1 * 6/2011 Neuhofer ..... E04F 19/061 52/718.01
2012/0174495 A1 * 7/2012 Nolan ..... E04F 19/045 52/58
2013/0235564 A1 * 9/2013 Barcelos ..... E04F 19/0477 362/151
2015/0068143 A1 * 3/2015 Plenet ..... E04F 13/0733 52/287.1
2015/0368913 A1 * 12/2015 Hatch ..... E04F 19/02 52/716.8
2016/0053500 A1 * 2/2016 Kawalec ..... E04F 19/0463 52/718.04
2016/0160510 A1 * 6/2016 O'Brien ..... E04F 19/0477 52/287.1
2016/0215508 A1 * 7/2016 Kimel ..... E04F 19/0477
2019/0290075 A1 * 9/2019 Fletcher ..... E04F 19/02
2021/0180336 A1 * 6/2021 Bordin ..... E04F 19/0477

FOREIGN PATENT DOCUMENTS

DE 202011110712 U1 9/2015
EP 3192939 A1 7/2017
GB 2124267 A 2/1984
GB 2516063 A 1/2015
JP 2004211469 A 7/2004
JP 2005053902 A 3/2005
WO 0150062 A1 7/2001
WO 2013038277 A2 3/2013

* cited by examiner

BASEBOARD

CROSS REFERENCE TO RELATED APPLICATIONS

This application is related to and claims the benefit of Italian Patent Application No. 102019000023565, filed on Dec. 11, 2019, the contents of which are herein incorporated by reference in their entirety.

TECHNICAL FIELD

The present disclosure relates to a baseboard.

BACKGROUND

As is known, a baseboard is a skirting board for covering the bottom part of vertical walls of interiors, of buildings or of stairs, in order to protect it during operations to clean the floor, or to enhance its aesthetic quality.

In its simplest form, a baseboard is constituted by a batten that has a predominantly longitudinal extension and is substantially rectangular in cross-section, but it can also take more elaborate forms, which include for example rounded corner edges, or feet, or the like.

Affixing the baseboard to the wall can occur in various ways.

For example, it is possible to use nails, which are applied with a nail gun or with a hammer, or screws which can be screwed directly to the wall, if the wall is not masonry, or to special inserts.

Furthermore, it is possible to affix the baseboard to the wall by the interposition of a layer of adhesive material, such as glue and/or cement material and/or silicone and/or the like, optionally in combination with nails.

The baseboard can be made of various materials, including wood, a material that was used to make the first models, marble and ceramic, which are usually used for models of higher worth, and metal, which is used for some modern or industrial environments.

Other material that is increasingly widely used to make baseboards is plastic, because it provides a good compromise between cost, mechanical performance and aesthetic value, if, for example, it is covered by a decorative film that reproduces the appearance of materials of high worth.

More precisely, a baseboard made of plastic is substantially constituted by profiled elements made for example of PVC, which are practically rectangular in cross-section and partially hollow.

The dimensions of such profiled elements are generally preset at the construction stage and are standardized in terms of both length and height.

On the basis of specific requirements, dictated for example by the dimensions of the walls and by the style of the environment, particular dimensional adaptations of the baseboard can therefore be required.

On the other hand, preparing baseboards with specific heights for each use could be excessively expensive for those running commercial enterprises.

With regard to dimensional adaptations, it should be noted that while adaptations of the length of the baseboard are relatively straightforward to carry out, the same cannot be said for adaptations of the height of the baseboard.

In fact, performing a longitudinal, straight, sharp cut along all of one of the longer sides of the baseboard is certainly not easy, so that the correct execution of this operation is generally entrusted to the manual ability of a technician.

It should further be considered that the profiled elements of plastic material that constitute the baseboard are generally covered by a decorative film that can reproduce the appearance of other materials, such as for example wood or marble, or more simply present a particular coloring.

The cutting operations can therefore cause fraying in the decorative covering.

SUMMARY

The aim of the present disclosure is to provide a baseboard that overcomes the above-mentioned drawbacks of the known art.

Within this aim, the disclosure provides a baseboard that allows versatile use as the specific requirements vary, without carrying out laborious adaptations.

The disclosure also provides a baseboard that makes it possible to adapt the height thereof in a simple and economical manner.

The disclosure further provides a baseboard wherein any adaptations of height do not compromise the aesthetic value thereof, independently of the ability of the technician.

The disclosure also provides a baseboard that can be positioned rapidly and safely.

The disclosure advantageously provides a baseboard that is relatively easy to construct and which, furthermore, is competitive from an economic viewpoint.

This aim and these and other advantages which will become more apparent hereinafter are achieved by providing a baseboard, comprising a profiled element having a substantially longitudinal extension, characterized in that it comprises one or more facilitated breakage regions which define respective detachable portions which can be detached from said profiled element.

BRIEF DESCRIPTION OF THE DRAWINGS

Further characteristics and advantages of the disclosure will become more apparent from the description of preferred, but not exclusive, embodiments of a baseboard according to the disclosure, which are illustrated for the purposes of non-limiting example in the accompanying drawings wherein.

DETAILED DESCRIPTION OF THE DRAWINGS

Figure 3:
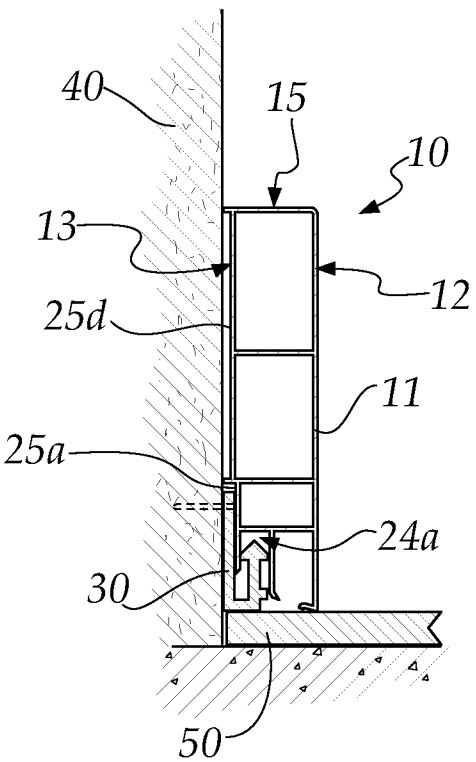
FIG. 3 is a cross-sectional view of the baseboard of FIG. 1 in a third configuration.

With reference to the figures, a baseboard is generally designated with the reference numeral 10, 110.

The baseboard 10, 110 comprises a profiled element 11 having a substantially longitudinal extension and a cross-section that is practically quadrangular.

The profiled element 11 is preferably made of plastic material, for example expanded PVC, and has a first face 12 which is designed to remain in view after the baseboard 10, 110 has been mounted and a second face 13, opposite from the previous face, which is designed to be affixed to a supporting structure 40, such as for example a wall, remaining hidden from view.

The profiled element 11 furthermore has a third face 14 which is designed to rest on a floor 50, and a fourth face 15, opposite from the previous face.

Preferably, the third face 14 is transverse, but non perpendicular, to the first face 12 and to the second face 13.

Figure 2:
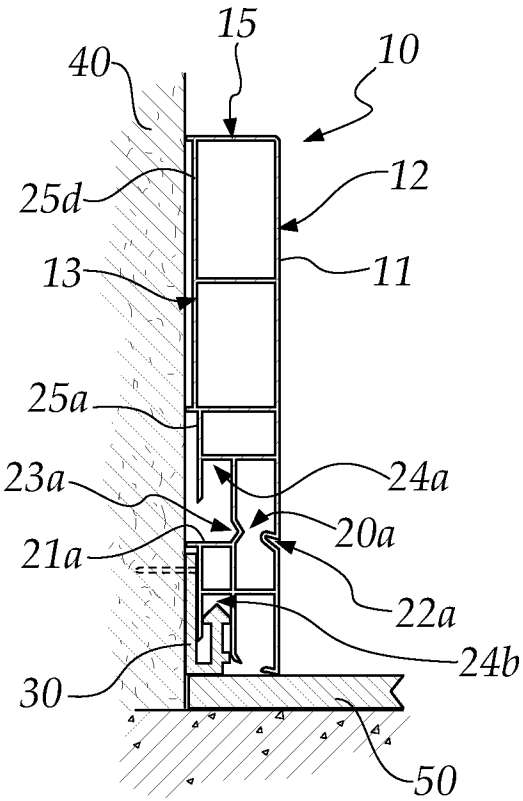
FIG. 2 is a cross-sectional view of the baseboard of FIG. 1 in a second configuration.
Figure 1:
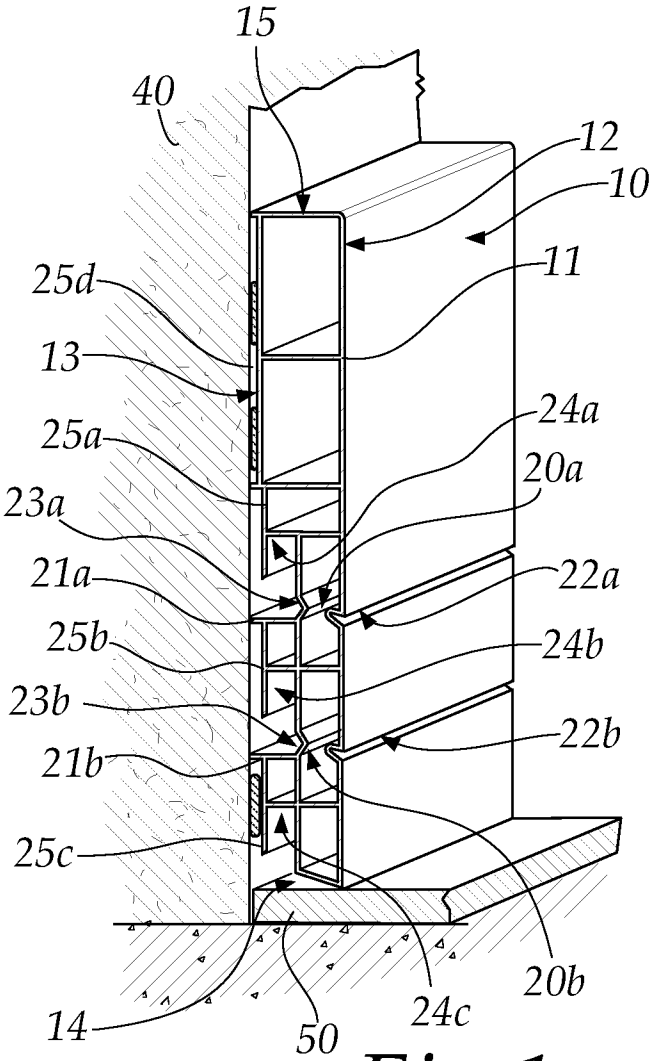
FIG. 1 is a cross-sectional view of a first embodiment of a baseboard according to the disclosure in a first configuration.

In a first embodiment illustrated in FIGS. 1 to 3, wherein the baseboard is generally designated with the reference numeral 10, the fourth face 15 is substantially flat and transverse to the first face 12.

Figure 4:
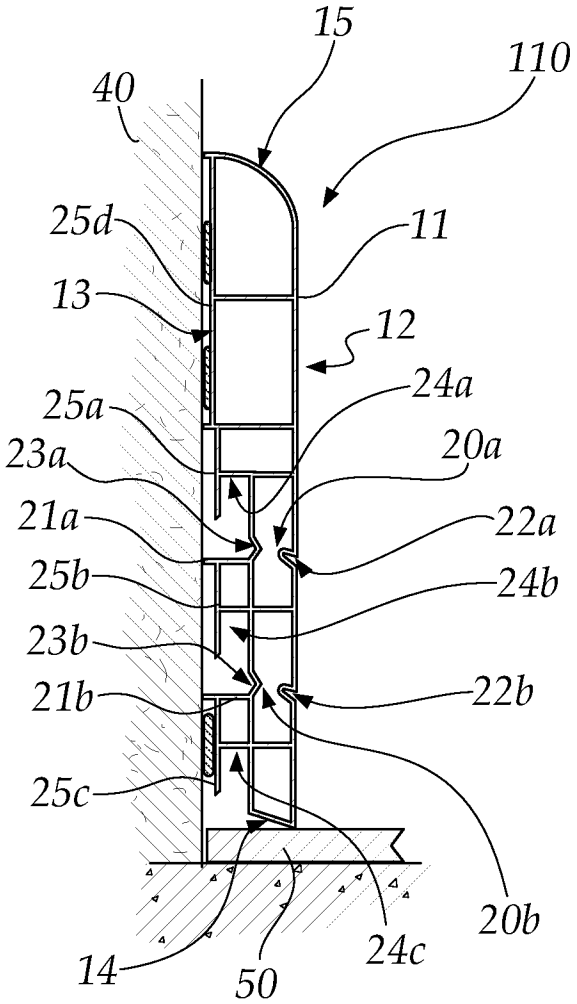
FIG. 4 is a cross-sectional view of a second embodiment of a baseboard according to the disclosure in a first configuration.
Figure 5:
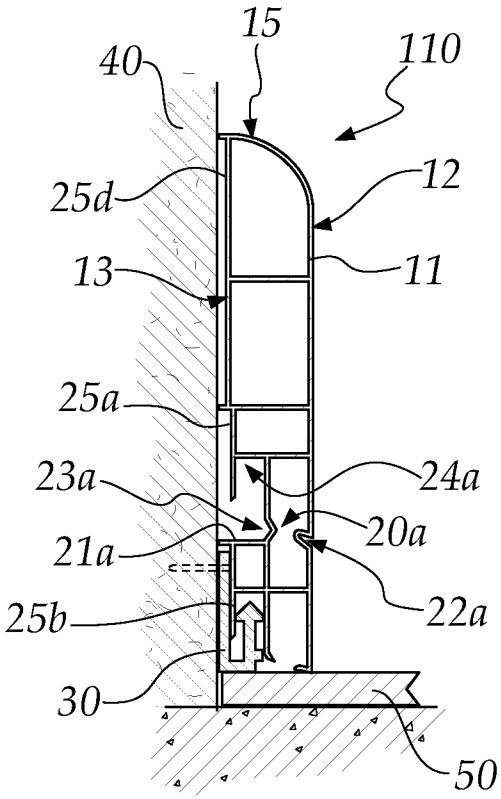
FIG. 5 is a cross-sectional view of the baseboard of FIG. 4 in a second configuration.
Figure 6:
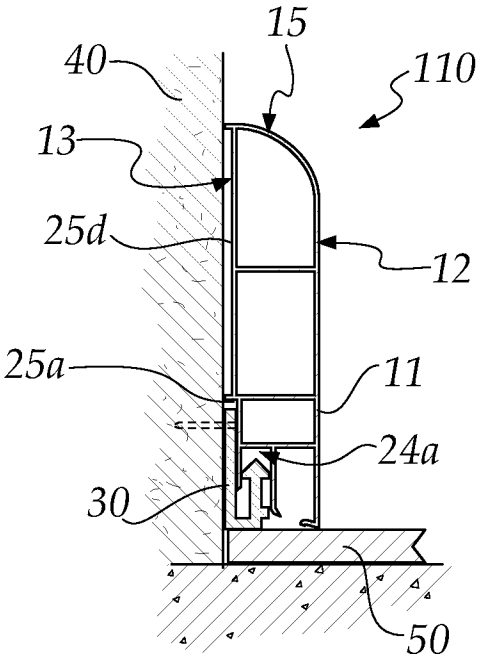
FIG. 6 is a cross-sectional view of the baseboard of FIG. 4 in a third configuration.

In a second embodiment illustrated in FIGS. 4 to 6, wherein the baseboard is generally designated with the reference numeral 110 and the corresponding elements are designated with the same numerals of FIGS. 1 to 3, the fourth face 15 is connected to the first face 12 with a portion that has a curvilinear external profile.

Preferably, the fourth face 15 and the first face 12 are covered by an outer film, not shown in the figures, which can have for example a decorative purpose.

According to the present disclosure, the baseboard 10, 110 comprises one or more facilitated breakage regions 20*a*, 20*b*, which define respective detachable portions 21*a*, 21*b* that can be removed from the profiled element 11.

In practice, the removal of the detachable portions 21*a*, 21*b* makes it possible to modify the height of the profiled element 11, i.e. the distance between the fourth face 15 and the original third face 14.

In the embodiments shown in the figures, there are two facilitated breakage regions 20*a*, 20*b* and two detachable portions 21*a*, 21*b*, but in different embodiments there can also be three or more, or only one.

Advantageously, the facilitated breakage regions 20*a*, 20*b* extend for the entire longitudinal extension of the profiled element 11 and are mutually parallel and equidistant.

In the embodiments shown in the figures, the two facilitated breakage regions 20*a*, 20*b* define two detachable portions 21*a*, 21*b* of the same height, which are arranged proximate to the third face 14 of the profiled element 11, but in different embodiments the two detachable portions 21*a*, 21*b* can have different heights and/or be arranged in different positions.

More precisely, the two facilitated breakage regions 20*a*, 20*b* are defined by first non-through incisions 22*a*, 22*b*, which are provided longitudinally on the first face 12 of the profiled element 11, and by second non-through incisions 23*a*, 23*b*, which are provided longitudinally on the second face 13 of the profiled element 11.

Such facilitated breakage regions 20*a*, 20*b* define a narrower region of the cross-section of the baseboard 10, 110, perpendicular to the supporting structure 40.

Advantageously, the first incisions 22*a*, 22*b* and the second incisions 23*a*, 23*b* mutually correspond, which means that the first incision 22*a* and the second incision 23*a* are located substantially at the same distance from the third face 14 of the profiled element 11, as are the first incision 22*b* and the second incision 23*b*.

Preferably, the first incisions 22*a*, 22*b* are originally covered and hidden from view by the film mentioned earlier.

Such film, in fact, is susceptible of being cut right at one of the first incisions 22*a*, 22*b* in order to allow the removal without fraying of at least one of the detachable portions 21*a*, 21*b*.

The baseboard 10, 110 also comprises one or more hollows 24*a*, 24*b*, 24*c*, which are defined longitudinally on the second face 13 of the profiled element 11 and are shaped to receive by interlocking at least one engagement element 30 which can be affixed to the supporting structure 40.

In the embodiments shown in the figures, there are three hollows 24*a*, 24*b*, 24*c*, which are shaped to receive an engagement element 30 with a substantially U-shaped cross-section, but in different embodiments their number, dimensions and geometry can be different from those indicated.

Preferably, the three hollows 24*a*, 24*b*, 24*c* are respectively arranged proximate to the second incisions 23*a*, 23*b*, and to the third face 14 of the profiled element 11.

The baseboard 10, 110 further comprises one or more recesses 25*a*, 25*b*, 25*c*, 25*d*, which are defined on the second face 13 of the profiled element 11 and are shaped to receive adhesive materials, such as glue, silicone, adhesive paste or other substantially equivalent means of adhesion.

The term "recess" is used here and below to indicate a recessed portion on the surface of the profiled element 11.

In the embodiments shown in the figures, there are four recesses 25*a*, 25*b*, 25*c*, 25*d*, which are respectively arranged proximate to the second incisions 23*a*, 23*b*, of the third face 14 of the profiled element 11 and of the fourth face 15 thereof, but in different embodiments their number, dimensions and geometry can be different from those indicated.

Use of the baseboard according to the present disclosure is simple and easy.

When purchased, the baseboard 10, 110 is in the condition of maximum height of the profiled element 11, as illustrated in FIGS. 1 and 4, and, if necessary, it is simply lowered in order to adapt it to different needs.

In this case, the adaptation of the height can occur with the removal of only the detachable portion 21*b*, as shown in FIGS. 2 and 5, or of both of the detachable portions 21*a*, 21*b*, as shown in FIGS. 3 and 6.

Such operation is helped by the facilitated breakage regions 20*a*, 20*b*, which make it possible to easily break the profiled element 11 along all its length.

In particular, the first incisions 22*a*, 22*b* make it possible to remove one or both of the detachable portions 21*a*, 21*b* while avoiding fraying of the film that covers part of the baseboard 10, 110.

Once the profiled element 11 has been adapted in terms of height, it is possible to affix the baseboard 10, 110 to the wall 40.

The affixing can occur, for example, using glue, silicone or other means of adhesion, previously deposited in one or more of the recesses 25*a*, 25*b*, 25*c*, 25*d*, as shown in FIGS. 1 and 4.

Alternatively, it is possible to improve the affixing of the baseboard 10, 110 to the wall 40 by coupling via interlocking one of the hollows 24*a*, 24*b*, 24*c* with an engagement element 30 that was previously affixed to the same wall 40, as shown in FIGS. 2, 3, 5 and 6.

In practice it has been found that the disclosure fully achieves the intended aim and advantages by providing a baseboard wherein it is possible to adapt the height thereof simply, rapidly and economically.

The presence of the facilitated breakage regions assists a precise separation of the removable portions, while avoiding fraying in the covering film.

Furthermore, positioning the baseboard in the disclosure is rapid and safe.

It should likewise be noted that the baseboard according to the disclosure also ensures significant advantages in terms of stock management.

The disclosure thus conceived is susceptible of numerous modifications and variations, all of which are within the scope of the appended claims. Moreover, all the details may be substituted by other, technically equivalent elements.

In practice the materials employed, provided they are compatible with the specific use, and the contingent dimensions and shapes, may be any according to requirements and to the state of the art.

What is claimed is:

1. A baseboard comprising:

a profiled element having a substantially longitudinal extension;

one or more facilitated breakage regions which define respective detachable portions which are configured to be detached from said profiled element, wherein said one or more facilitated breakage regions extend over an entire longitudinal extension of said profiled element and are mutually parallel, said one or more facilitated breakage regions comprise respective first non-through longitudinal incisions defined on a first face of said profiled element and configured to remain in view, and further comprise respective second non-through longitudinal incisions defined on a second face of said profiled element and configured to remain hidden from view, said second face of said profiled element being substantially opposite to said first face of said profiled element, said second non-through longitudinal incisions being arranged respectively at said first non-through longitudinal incisions.

2. The baseboard according to claim 1, further comprising a film applied to said first face of said profiled element to cover said first non-through longitudinal incisions, said film being susceptible to be cut at at least one of said first non-through longitudinal incisions to allow removing without fraying of at least one of said detachable portions.

3. The baseboard according to claim 1, further comprising one or more longitudinal hollows defined on said second face of said profiled element, said longitudinal hollows being shaped to receive by interlocking at least one engagement element configured to be affixed to a supporting structure.

4. The baseboard according to claim 3, wherein said one or more longitudinal hollows are arranged proximate to said second incisions and proximate to a third face of said profiled element, which is designed to rest on a floor.

5. The baseboard according to claim 1, further comprising one or more recesses defined on said second face of said profiled element, said recesses being shaped to receive adhesive materials.

6. The baseboard according to claim 1, wherein at least one of the first non-through longitudinal incisions and at least one of the second non-through longitudinal incisions are located equidistant from a third face of said profiled element.

* * * * *